United States Patent [19]

Ohkura

[11] Patent Number: 4,992,411

[45] Date of Patent: Feb. 12, 1991

[54] THERMAL RECORDING PAPER

[75] Inventor: Hirokazu Ohkura, Tokyo, Japan

[73] Assignee: Mitsubishi Paper Mills Limited, Tokyo, Japan

[21] Appl. No.: 464,390

[22] Filed: Jan. 12, 1990

[30] Foreign Application Priority Data

Jan. 12, 1989 [JP] Japan ..... 01-007430

[51] Int. Cl.[5] ..... B41M 5/18

[52] U.S. Cl. ..... 503/200; 427/152; 428/211; 428/537.5; 503/226

[58] Field of Search ..... 427/150–152; 503/200, 226; 428/211, 537.5

[56] References Cited

FOREIGN PATENT DOCUMENTS 0069094 4/1983 Japan ..... 503/200

OTHER PUBLICATIONS

J. Tappi Paper and Pulp Testing Method No. 51–87, Method for Determining the Liquid Absorbability of Paper and Board (Bristow's Method and Translation Thereof).

M. B. Lyne et al., "Wetting and the Sorption of Water by Paper Under Dynamic Conditions," Paper Physics, Dec. 1982/Tappi Journal.

*Primary Examiner*—Pamela R. Schwartz

*Attorney, Agent, or Firm*—Cushman, Darby & Cushman

[57] ABSTRACT

There is disclosed a thermal recording paper comprising a support having a roughness index, measured by the method of liquid absorption test on paper and board (Bristow's method) in Japan TAPPI paper pulp test method No. 51-87, of not more than 8 ml/m$^2$, a thermal recording layer, and an intermediate layer formed therebetween.

4 Claims, No Drawings

THERMAL RECORDING PAPER

BACKGROUND OF THE INVENTION

1. Field of the Invention

This invention relates to thermal recording paper for recording by means of a thermal head, thermal pen, etc.

2. Related Art

Thermal recording paper found its first use in printers for medical and measurement purposes, and has recently found an increasing use in fields of facsimiles and terminal devices for image output. With an increase in the use, there is an increasing need for thermal recording paper having higher sensitivity and higher quality than it has had conventionally. To meet this need, an attempt has been made to optimize materials for thermal recording layers and their dispersing method. Since, however, this optimization has not been sufficient to obtain a satisfactory effect, there is another practice, as an approach through physical properties of paper, to improve surface smoothness of the thermal recording paper thereby to improve its contact intimacy with a thermal head.

The surface smoothness of the thermal recording paper is improved by carrying out various calender treatments on the surface of paper coated with a thermal recording layer.

In improvement of the surface smoothness by means of calender treatment, however, the strengthening of the treatment conditions causes more frequent sticking and adherence of foreign matter to a thermal head, although the surface smoothness is improved and the recording density is increased.

Further, the calender treatment of the thermal recording paper involves a problem of surface fog that a paper surface undergoes coloring due to pressure. If the surface fog occurs on the thermal recording paper surface, the paper brightness is degraded, and a fibrous pattern, which appears on the surface, greatly deteriorates appearance of the thermal recording paper.

For this reason, when the thermal recording paper surface is smoothened for higher sensitivity, it is necessary to take into account a balance among recording density, sticking and adherence of foreign matter to a thermal head, and surface fog, and it is hence required to adjust the smoothness to a certain level. Thus, the intended increase of the sensitivity is prevented.

Therefore, in smoothing of the surface of the thermal recording paper by calender treatment to achieve high sensitivity, the effect thereof is necessarily limited, and at present, no thermal recording paper having satisfactory sensitivity has been obtained. Further, it is also proposed to form an intermediate layer between a support and a recording layer in order to achieve high sensitivity and prevent occurrence of foreign matter and sticking. In fact, however, such a proposal is not sufficient to obtain any satisfactory effect, either.

The reason therefor is considered as follows. If an intermediate layer having a sufficient thickness is not formed on convex portions of a pulp fiber on a base paper sheet, the formed intermediate layer still has a residual undulation derived from the concavoconvex form of the base paper surface. And in a calender treatment step after coating of a thermal recording layer, the residual undulation prevents a uniform contact between the thermal recording paper surface and a calender roll, and the thermal recording layer has its surface smoothened nonuniformly. Hence, it is only nonuniformly colored image records that can be obtained.

If the calender treatment is effected under strong conditions to obtain uniform smoothness, there are caused a sticking, increase in adherence of foreign matter to a thermal head and surface fog.

In theory, therefore, the undulation derived from the concavoconvex form of the base paper surface disappears if an intermediate layer having a sufficient thickness is formed on a pulp fiber on the base paper surface, and as a result, the thermal recording paper surface and the calender roll are uniformly brought into contact. Hence, the calender treatment conditions can be set at a moderate level, and it is possible to achieve high sensitivity without any sticking, increase in adherence of foreign matter to a thermal head and surface fog. In other words, the concave portion of the base paper surface is filled with a material for a coating as an intermediate layer, and thereafter, the intermediate layer having a smoother surface is formed on a pulp fiber on the base paper surface. Thus, the formation of the intermediate layer having a sufficient thickness can be accomplished by decreasing the apparent volume of the concave portion of the base paper surface.

That is, the above-discussed problems can be also solved by increasing the amount of the intermediate layer or thermal recording layer. Since, however, the amount increase causes curling, and since the excess amount impairs the paper properties, this solution cannot be any fundamental solution.

SUMMARY OF THE INVENTION

It is an object of this invention to provide thermal recording paper which has excellent respondency to heat and causes no surface fog, i.e. to cope with requirements, which prior techniques fail to meet, for achievement of higher sensitivity and improvement of dot reproducibility.

The present inventors have sought to achieve higher sensitivity of the thermal recording paper and prevent occurrence of foreign matter and sticking by studying a variety of conventional thermal recording paper sheets having an intermediate layer, and found that the surface smoothness of the thermal recording paper is under the control of the volume of the base paper sheet thereof to a great extent, which finding has led to this invention.

That is, the present inventors made a study of methods for assessment of the concave portion volume of the base paper surface in order to find out base paper sheets of which the concave portion volume is small. As a result, we have found that a roughness index measured by Bristow's method specified in Japan TAPPI paper pulp test method No. 51-87 correlates with the concave portion amount, and that quantitative assessment of the concave portion can be made by measuring said index. The present invention has been completed on the basis of this finding.

DETAILED DESCRIPTION OF PREFERRED EMBODIMENTS

According to this invention, when those having a roughness index, measured by the above method, of not more than 8 ml/m$^2$, preferably not more than 7 ml/m$^2$ are used as a base paper sheet which is a support, it is possible to obtain thermal recording paper sheets which are imparted, as thermal recording paper having an intermediate layer, with sufficient heat-sensitivity characteristics under moderate calender conditions. In addition, the above roughness index stands for a value obtained by measurement using a head box with a slit opening degree of 0.5 mm and water as a permeating liquid.

In addition, those having a roughness index meeting the above conditions may be used as a base paper sheet regardless of a production process thereof. Since, however, some base paper sheets have a "returning" phenomenon when they are coated with an intermediate layer, and undergoes a greater undulation, it is desirable to study them fully before use to see whether or not unacceptable returning phenomenon occurs.

In addition, base paper sheets having a density of not less than 0.8 g/cm$^3$, which are prepared from a pulp having a pulp freeness of 400 to 200 ml C.S.F. (Canadian Standard Freeness), preferably 300 to 200 ml C.S.F., e.g. under a strong pressure of not less than 60 kg/cm as a wet press pressure at a paper-making rate of 200 m/min., are almost free from the returning phenomenon and suitably usable as a base paper sheet in this invention.

As a base paper sheet of this invention, it is naturally possible to use those having a density of 0.8 g/cm$^3$ or more manufactured by only wet press, or by a combination of wet press and on-machine calender, or those manufactured by further treating these base paper sheets with super calender and/or gloss calender.

For the base paper usable in the thermal recording paper of this invention, it is possible to use, as required, raw materials usually usable in paper making such as wood pulp, synthesis pulp, filler, sizing agent, paper reinforcing agent, dye, etc.

Pigments usually usable in coated paper, etc., may be used as a pigment in the intermediate layer of this invention, and examples thereof include calcium carbonate, kaolin, calcined kaolin, zinc oxide, titanium oxide, aluminum hydroxide, zinc hydroxide, barium sulfate, silicon oxide, urea-formaldehyde resin powder, etc.

Among the above pigments, those pigments capable of oil absorption of not less than 70 ml/100 g, calcined kaolin and silicon oxide in particular, are preferably usable since they adsorb thermal layer components melted under heat without involving any opacifying effect, and also have an effect of decreasing adherence of foreign matter to a thermal head.

Concerning dye precursors usable in this invention, there is no special limitation to be imposed thereon, if they are generally usable in pressure-sensitive recording paper and heat-sensitive recording paper. The specific examples thereof are as follows.

(1) Triarylmethane Compounds 3,3-bis(p-dimethylaminophenyl)-6-dimethylaminophthalide(crystalvioletlactone), 3,3-bis(p-dimethylaminophenyl)phthalide, 3-(p-dimethylaminophenyl)-3-(1,2-dimethylindol-3-yl)phthalide, 3-(p-dimethylaminophenyl)- 3-(2-methylindol-3-yl)phthalide, 3-(p-dimethylaminophenyl)-3-(2-phenylindol-3-yl)phthalide, 3,3-bis(1,2-dimethylindol-3-yl)-5-dimethylaminophthalide, 3,3-bis(l,2-dimethylindol-3-yl)-6-dimethylaminophthalide, 3,3-bis(9-ethylcarbazol-3-yl)-5-dimethylaminophthalide, 3,3-bis(2-phenylindol-3-yl)-5-dimethylaminophthalide, 3-p-dimethylaminophenyl-3-(1-methylpyrrol-2-yl)-6dimethylaminophthalide, etc.

(2) Diphenylmethane Compounds 4,4'-bis-dimethylaminophenylbenzhydrylbenzyl ether, N-halophenylleuco Auramine, N-2,4-5-trichlorophenyllenuco Auramine, etc.

(3) Xanthene Compounds rhodamine B anilinolactam, rhodamine B-p-chloroanilinolactam. 3-diethylamino-7-dibenzylaminofluoran, 3-diethylamino-7-octylaminofluoran, 3-diethylamino-7-phenylfluoran, 3-diethylamino-7-chlorofluoran, 3-diethylamino-6-chloro-7-methylfluoran, 3-diethylamino-7-(3,4-dichloroanilino)fluoran, 3-diethylamino-7-(2-chloroanilino)fluoran, 3-diethylamino-6-methyl-7-anilinofluoran, 3-(N-ethyl-N-tolyl)amino-6-methyl-7-anilinofluoran, 3-piperidino-6-methyl-7-anilinofluoran, 3-(N-ethyl-N-tolyl)amino-6-methyl-7-phenethylfluoran, 3-diethylamino-7-(4-nitroanilino)-fluoran, 3-dibutylamino-6-methyl-7-anilinofluoran, 3-(N-methyl-N-propyl)amino-6-methyl-7-anilinofluoran, 3-(N-ethyl-N-isoamyl)amino-6-methyl-7-anilinofluoran, 3-(N-methyl-N-cyclohexyl)amino-6-methyl-7-anilinofluoran, 3-(N-ethyl-N-tetrahydrofuryl)amino-6-methyl-7-anilino fluoran, etc.

(4) Thiazine Compounds benzoylleucomethylene blue, p-nitrobenzoylleucomethylene blue, etc.

(5) Spiro Compounds 3-methylspirodinaphthopyran, 3-ethylspirodinaphthopyran, 3,3'-dichlorospirodinaphthopyran, 3-benzylspironaphthopyran, 3-methylnaphtho-(3-methoxybenzo)-spiropyran, 3-propylspirobenzopyran, etc.

These precursors may be used alone or in combination.

Concerning developers usable in this invention, compounds having electron-accepting nature, generally used in thermal recording paper are usable as such. In particular, phenol derivatives, aromatic carboxylic acid derivatives or metal compounds thereof, N,N'-diarylthiourea derivatives, and the like are usable. Particularly preferable of these are phenol derivatives, and specific examples thereof include 1,1-bis(p-hydroxyphenyl)-propane, 2,2-bis(p-hydroxyphenyl)propane, 2,2-bis(p-hydroxyphenyl)butane, 2,2-bis(p-hydroxyphenyl)hexane, bisphenolsulfone, bis(3-allyl-4-hydroxyphenyl)sulfone, 4-hydroxy-4'-isopropyloxydiphenylsulfone, 3,4-dihydroxy- 4'-methyldiphenylsulfone, diphenyl ether, benzyl-p-hydroxybenzoate, propyl-p-hydroxybenzoate, butyl-p-hydroxybenzoate, etc.

Examples of binders usable in this invention are water-soluble binders such as starches, hydroxyethyl cellulose, methyl cellulose, carboxymethyl cellulose, gelatin, casein, polyvinyl alcohol, modified polyvinyl alcohol, sodium polyacrylate, acrylic acid amide/acrylic acid ester copolymer, acrylic acid amide/acrylic acid ester/methacrylic acid terpolymer, alkali salt of styrene/maleic anhydride copolymer, alkali salt of ethylene/maleic anhydride, etc., latices such as polyvinyl acetate, polyurethane, polyacrylic acid ester, styrene/butadiene copolymer, acrylonitrile/butadiene copolymer, methyl acryalte/butadiene copolymer, ethylene/vinyl acetate copolymer, etc.

Further, it is also possible to incorporate the following sensitizers to improve sensitivity. Waxes such as N-hydroxymethylstearic acid amide, stearic acid amide, palmitic acid amide, etc., naphthol derivatives such as 2-benzyloxynaphthalene, biphenyl derivatives such as p-benzylbiphenyl, 4-allyloxybiphenyl, etc., polyether compounds such as 1,2-bis(3-methylphenoxy)-ethane, 2,2'-bis(4-methoxyphenoxy)diethyl ether, bis(4-methoxyphenyl) ether, etc., and carbonic acid or oxalic acid diesters such as diphenyl carbonate, dibenzyl oxalate, di(p-chlorobenzyl)oxalate, etc.

Concerning pigments usable in the thermal recording layer, examples thereof include diatomaceous earth, talc, kaolin, calcined kaolin, calcium carbonate, magnesium carbonate, titanium oxide, zinc oxide, silicon oxide, aluminum hydroxide, urea-formalin resin, etc.

Furthermore, the following may be optionally added to prevent abrasion of a head, sticking, etc. Higher fatty acid metal salts such as zinc stearate, calcium stearate, etc., waxes such as paraffin, paraffin oxide, polyethylene, polyethylene oxide, stearic acid amide, castor wax, etc., dispersants such as sodium dioctylsulfosuccinate, sulfonic acid-modified polyvinyl alcohol, etc., UV light absorbers of benzophenone type, benzotriazole type, etc., surfactants, fluorescent dyes, etc.

In this invention, the thermal recording paper can be formed by a known coating method, such as a blade-coating, air-knife coating, gravure coating, roll-coating, bar-coating, or drop curtain-coating method. It is further possible to form an overcoat layer for the purpose of protecting the thermal recording layer, etc.

EXAMPLES

The present invention will be explained further in detail by reference to Examples, in which "part" and "%" are all based on weight.

Further, values for the amount of coatings stand for those of dried coatings unless otherwise specified.

PREPARATION EXAMPLE 1

A coating liquid for an intermediate layer was prepared by dispersing a mixture having the following formulation.

| | |
|---|---|
| Calcined kaoline (Ansilex manufactured by Engelhard) | 100 parts |
| Ethylene-butadiene copolymer latex (50% water dispersion) | 24 parts |
| Phosphate-esterified starch (MS-4600, manufactured by Nippon Shokuhin Kako Co., Ltd., 10% water solution) | 60 parts |
| Water | 52 parts |

PREPARATION EXAMPLE 2

Liquids A and B were prepared by milling and dispersing each of mixtures having the following formulations until their average particle diameter became about 1 μm.

| | |
|---|---|
| [Liquid A] | |
| 3-(N-Methyl-N-cyclohexyl)amino-6-methyl-7-anilinofluoran | 40 parts |
| 10% polyvinyl alcohol water solution | 20 parts |
| Water | 40 parts |
| [Liquid B] | |
| Bisphenol A | 50 parts |
| 2-Benzyloxynaphthalene | 50 parts |
| 10% polyvinyl alcohol water solution | 50 parts |
| Water | 100 parts |

A heat-sensitive coating liquid having the following formulation including the liquids A and B was prepared.

| | |
|---|---|
| Liquid A | 50 parts |
| Liquid B | 250 parts |
| Zinc stearate (40% dispersion) | 25 parts |
| 10% polyvinyl alcohol water solution | 216 parts |
| Calcium carbonate | 50 parts |
| Water | 417 parts |

EXAMPLE 1

A conifer kraft pulp (30 parts) and 70 parts of a broad-leaved tree kraft pulp were beat up to a Canadian standard freeness of 200 ml, and 10 parts of precipitating calcium carbonate (TP-121, manufactured by Okutama Kogyo Co., Ltd.), 2 parts of cationic starch (CatoF, manufactured by Oji-National Co., Ltd.) and 0.2 part of a neutral sizing agent (Hercon W, manufactured by Dick-Hercules Co., Ltd.) were added, and base paper sheets having a basis weight of 45 g/m$^2$ and a density of 0.80 g/cm$^3$ were prepared by using a Fourdrinier machine with a tripple weave plastic wire (TT-5000, manufactured by Nippon Filcon Co., Ltd.). In addition, these base paper sheets were coated with 3.5 g/m$^2$ of oxidized starch by using a size press coater.

Further, one surface of each of the base paper sheets was coated with 8 g/m$^2$ of the coating liquid for an intermediate layer, prepared in Preparation Example 1, by using a blade coating machine, and then 3 g/m$^2$ of the heat-sensitive coating liquid prepared in Preparation Example 2 was coated thereon by using an air knife coating machine. The resultant sheets coated with a thermal recording layer were treated with a super calender in such a manner that the thermal recording surface was in contact with a mirror surface roll, whereby thermal recording paper sheets were obtained.

EXAMPLE 2

The procedure of Example 1 was repeated and a Fourdrinier machine was used to prepare base paper sheets having a basis weight of 45 g/m$^2$. In this case, the wet press linear pressure was changed so as to obtain base paper sheets having a density of 0.85 g/m$^2$.

These base paper sheets were treated in the same way as in Example 1 to give thermal recording paper sheets.

EXAMPLE 3

The procedure of Example 1 was repeated except that base paper sheets were treated with a super calender, whereby thermal recording paper sheets were obtained.

COMPARATIVE EXAMPLES

The procedure of Example 1 was repeated except that the base paper density was changed to 0.75 g/cm$^3$ by decreasing the wet press linear pressure.

Table 1 shows the results of all of the above Examples.

TABLE 1

| | Roughness index (ml/m$^2$) | Printing density (O.D) | Surface fog |
|---|---|---|---|
| Example 1 | 8.0 | 0.84 | |
| Example 2 | 7.6 | 0.86 | |
| Example 3 | 6.8 | 0.90 | |
| Comparative | 9.0 | 0.65 | X |

TABLE 1-continued

| | Roughness index ($ml/m^2$) | Printing density (O.D) | Surface fog |
|---|---|---|---|
| Example | | | |

Surface fog:
Excellent,
Good,
X Inferior

Concerning the printing density in Table 1, a G III facsimile tester (TH-PMD, manufactured by Okura Denki) with a thermal head having a dot density of 8 dots/mm and a head resistance of 185 Ω was used for printing under conditions that the charged voltage and electricity application time were 11 v and 0.6 millisecond, and the reflection density of the printed portion was measured by using a Macbeth densitometer (RD-918).

The thermal recording paper is required to have the sensitivity which can give a printing density of not less than 0.8.

As is clear from the results shown in Table 1, the thermal recording paper of this invention having the intermediate layer between the thermal recording layer and the support and using, as the support, a base paper having a roughness index, measured by Bristow's method, of not more than 8 $ml/m^2$ clearly exhibits a high printing density and is free from surface fog.

What is claimed is:

1. Thermal recording paper comprising a paper support having a roughness index, measured by the method of liquid absorption test on paper and board (Bristow's method) in Japan TAPPI paper pulp test method No. 51-87, of not more than 8 $ml/m^2$, a thermal recording layer, and an intermediate layer formed therebetween.

2. Thermal recording paper according to claim 1, wherein the support has a roughness index of 7 $ml/m^2$.

3. Thermal recording paper according to claim 1, wherein the support is a base paper sheet having a density of not less than 0.8 $g/cm^3$ and prepared from a pulp having a pulp freeness of 400 to 200 ml Canadian Standard Freeness at a paper-making rate of 200 m/minute under a strong pressure of not less than 60 kg/cm as a wet press pressure.

4. Thermal recording paper according to claim 1, wherein the intermediate layer is formed of a pigment having an oil absorption of not less than 70 ml/100 g.

* * * * *